US006530802B2

(12) United States Patent
Letourneau

(10) Patent No.: US 6,530,802 B2
(45) Date of Patent: Mar. 11, 2003

(54) LATCH AND RELEASE MECHANISM FOR AN ELECTRICAL CONNECTOR

(75) Inventor: Guy Louis Letourneau, Warren, OR (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 10/013,241

(22) Filed: Nov. 5, 2001

(65) Prior Publication Data

US 2002/0111061 A1 Aug. 15, 2002

Related U.S. Application Data

(63) Continuation of application No. 09/781,840, filed on Feb. 12, 2001, now Pat. No. 6,358,082.

(51) Int. Cl.[7] ..... H01R 13/64

(52) U.S. Cl. ..... 439/372; 439/310; 439/347; 439/342

(58) Field of Search ..... 439/352, 489, 439/353, 357, 358, 923, 362, 310, 160, 347

(56) References Cited

U.S. PATENT DOCUMENTS

| | | | | | |
|---|---|---|---|---|---|
| 3,568,131 | A | | 3/1971 | Kennedy | 439/55 |
| 3,582,867 | A | * | 6/1971 | Thompson | 439/362 |
| 4,045,109 | A | | 8/1977 | Langenbach et al. | 439/372 |
| 4,873,614 | A | * | 10/1989 | Lichtensperger | 439/358 |
| 4,952,161 | A | | 8/1990 | Komatsu | 439/155 |
| 5,066,244 | A | * | 11/1991 | Kato et al. | 439/489 |
| 5,201,665 | A | | 4/1993 | McCardell, Jr. et al. | 439/157 |
| 5,322,448 | A | | 6/1994 | Hahn | 439/157 |
| 5,338,227 | A | * | 8/1994 | Nakamura | 439/352 |
| 5,376,016 | A | | 12/1994 | Inaba et al. | 439/364 |
| 5,411,402 | A | | 5/1995 | Bethurum | 439/77 |
| 5,425,654 | A | | 6/1995 | Colleran et al. | 439/372 |
| 5,554,045 | A | | 9/1996 | Bethurum | 439/372 |
| 5,564,939 | A | * | 10/1996 | Maitani et al. | 439/352 |
| 5,620,328 | A | | 4/1997 | Yamamoto et al. | 439/157 |
| 5,669,512 | A | * | 9/1997 | Joslin | 361/798 |
| 5,713,752 | A | * | 2/1998 | Leong et al. | 439/358 |
| 5,720,623 | A | * | 2/1998 | Polenick et al. | 439/352 |
| 5,833,484 | A | | 11/1998 | Post et al. | 439/352 |
| 5,951,316 | A | * | 9/1999 | Kawano et al. | 439/352 |
| 5,964,605 | A | | 10/1999 | Heydorn et al. | 439/159 |
| 5,980,281 | A | * | 11/1999 | Neal et al. | 439/157 |

* cited by examiner

*Primary Examiner*—P. Austin Bradley
*Assistant Examiner*—Briggitte R. Hammond
(74) *Attorney, Agent, or Firm*—Harrington & Smith, LLP

(57) ABSTRACT

An electrical connector assembly includes a headshell with a first connector for terminating a plurality of electrical leads intended for mechanical and electrical connection with a mating second connector. An elongated latch member is freely received within a passage which extends between front and rear faces of the headshell and has first and second lateral sidewalls, the latch member being simultaneously movable by an external actuator longitudinally and laterally between a first retracted position interfering with connection of the first and second mating connectors and a second advanced position enabling connection of the first and second connectors. When returned to the first position, a grapnel blade on the latch member becomes lockingly engaged with a housing for the second connector. In this condition, the first and second connectors are mechanically and electrically connected. In the first position, the latch member lies proximate the second side wall and in the second position, it lies proximate the first side wall.

5 Claims, 6 Drawing Sheets

FIG. 1
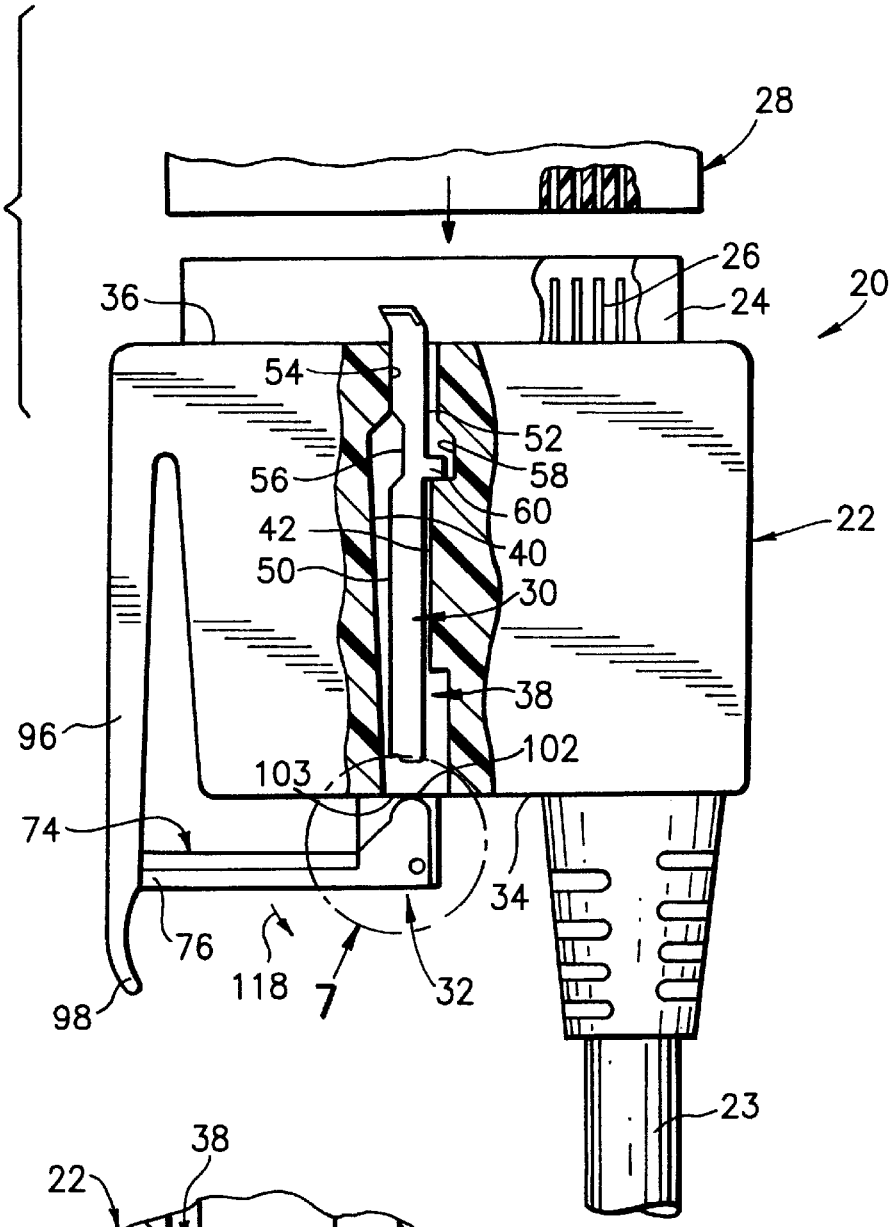
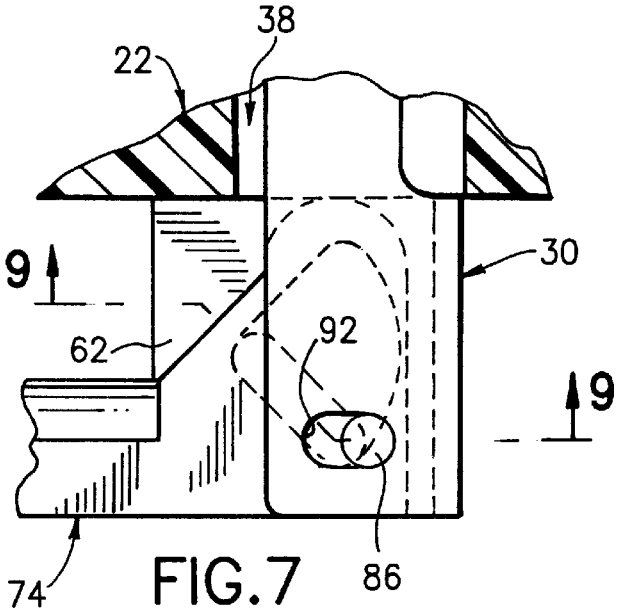
FIG. 7
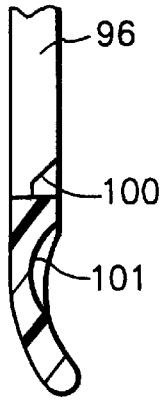
FIG. 15

LATCH AND RELEASE MECHANISM FOR AN ELECTRICAL CONNECTOR

This is continuation of application Ser. No. 09/781,840, filed Feb. 12, 2001, now U.S. Pat. No. 6,358,080.

BACKGROUND OF THE INVENTION

1. Field of the Invention

The present invention relates to multi terminal electrical connectors and, more particularly, to a simplified but effective mechanism for readily mating and unmating a pair of connectors and for securely maintaining them in the mated condition until their release is desired.

2. Brief Description of Earlier Developments

Electrical connectors are used in a variety of applications for making large numbers of electrical interconnections. A connector typically includes two components: a housing or other body member and a plurality of terminals or electrical contact elements mounted on the housing. A connector may be attached to the end of a multi-conductor cable, and a second connector may be mechanically and electrically interconnected to a printed circuit or wiring board, or both connectors may be attached to cables or both connectors may be interconnected to a pair of boards. Regardless of the application, electrical connectors often are difficult to mate or interconnect when they mount a large number of terminals.

With the increasing use of electrical and electronic components in a wide variety of consumer products, the provision of reliable electrical connections to and between such components has become increasingly difficult, for not only are larger numbers of components being used, but the components are becoming more complex, requiring larger numbers of wires and connectors. With miniaturization of the electronics, the space available in many consumer products is becoming crowded, and all of these factors combine to magnify the problem of installing, replacing, or repairing the electronic components. Typically, such components are interconnected by means of complex wiring harnesses which may incorporate large numbers of wires and cables. These harnesses usually are fashioned with standardized connectors at their ends to permit them to be connected directly to corresponding terminals on the components or to permit them to be interconnected with other wires, cables, or harnesses. Such connectors must permit easy and accurate connection of the wiring harnesses and in addition must be easily releasable to permit quick repair or replacement of electrical components, wiring harnesses, or the like. Such connectors must be not only easy to use, but must be extremely rugged so that they can withstand multiple connections and disconnections, while at the same time being capable of withstanding harsh environmental conditions.

Furthermore, as the number of cables and harnesses increases, the space available for mounting these connectors becomes more limited, with the result that the dimensions of the connectors themselves must be reduced, even as the number of terminals they can accommodate—must be increased. Typically, a multi terminal connector includes a first connector element which incorporates a large number of terminal pins or blades and a second, complementary, connector element which incorporates a large number of terminal sockets. To assemble these two connector elements, the terminal pins or blades must engage corresponding terminal sockets and be seated firmly therein so that the required electrical connections between individual wires in a wiring harness are completed. Although an individual pin or blade may require only a moderate amount of force to engage a corresponding socket, as the number of terminals increases within a connector, and/or as the size of the pins or blades and sockets decreases, and as the pins or blades and sockets become more closely spaced due to miniaturization, the force required to assemble the connector plug and receptacle terminals is multiplied many times over. As a result, assembly or disassembly of connectors with large numbers of terminals becomes a significant problem. Similar problems are encountered when attempting to separate the two elements of a connector, for with a large number of terminals, the force required to pull them apart can be quite large. This is particularly a problem when the connector elements have been assembled for a long period of time in a harsh environment which tends to freeze the components together. In addition, where the connector is dimensionally small with a large number of terminal pins or blades and sockets packed close together, the forces required to assemble or disassemble the connector elements can be very high, making it very difficult to manually press the parts together or pull them apart, particularly if the connector is in a location which is hard to reach.

One solution to this problem has been the provision of bolts which pass through one connector element and engage corresponding threaded brass inserts embedded in the other connector element. By tightening the bolts the two connectors are drawn together to assemble the connector. However, although often used, such an arrangement has numerous disadvantages. For example, the bolt arrangement requires the use of a special tool such as a pneumatic wrench, and in addition requires extra manufacturing steps and extra cost to mate the necessary brass inserts and to embed them in the connector housing. If the bolt is cross-threaded during assembly of the connector, the connector and its attached harness may be made unusable, thus increasing the cost of such an approach to the assembly of two part connectors.

A number of patents typify conventional assemblies. For example, U.S. Pat. No. 3,568,131 to Kennedy discloses an electrical cable connector for joining flat connector cables using a pair of screw jacks. U.S. Pat. No. 4,952,161 to Komatsu discloses a card connector including an ejector mechanism for releasably connecting a memory card such as a PCMCIA card to a computer.

The following patents disclose various mechanisms for releasably locking mating housings of a two-part multi terminal electrical connector: For example, in U.S. Pat. No. 5,201,665 to McCardell, Jr. et al., a cam lock mechanism engages a simple follower stub or peg integral to the mating member. U.S. Pat. No. 5,322,448 to Hahn discloses an involute gearing or rack and pinion system for mating and unmating the opposed electrical connectors. U.S. Pat. No. 5,425,654 to Colleran et al. discloses a mechanism according to which a cam mechanism or first mating connector engages a follower on a second mating connector. The follower, in the form of a peg is mounted on an essentially rigid bar and is part of the second connector. In U.S. Pat. No. 5,620,328 to Yamamoto et al. a pivotal plate is pivotally disposed on one of a pair of housings adapted to be mutually coupled. A pair of leaf springs are interposed between one of the housings and the pivotal plate. A latch is provided for locking the two housings upon coupling. When the pair of housings is to be coupled, the pivotal plate is pivoted by the action of the leaf springs, and this occurs after the two housings reach an intermediate state of coupling. U.S. Pat. No. 5,833,484 to Post et al. discloses another involute stub operating as a rack and pinion to drive a first connector downward onto a second connector.

SUMMARY OF THE INVENTION

The present invention relates to an electrical connector assembly which includes a headshell with a first connector for terminating a plurality of electrical leads intended for mechanical and electrical connection with a mating second connector. An elongated latch member is freely received within a passage which extends between front and rear faces of the headshell and has first and second lateral sidewalls, the latch member being simultaneously movable by an external actuator longitudinally and laterally between a first retracted position interfering with connection of the first and second mating connectors and a second advanced position enabling connection of the first and second connectors. When returned to the first position, a grapnel blade on the latch member becomes lockingly engaged with a housing for the second connector. In this condition, the first and second connectors are mechanically and electrically connected. In the first position, the latch member lies proximate the second side wall and in the second position, it lies proximate the first side wall.

A primary feature, then, of the present invention is the provision of a simplified but effective mechanism for readily mating and unmating a pair of connectors and for securely maintaining them in the mated condition until their release is desired.

Another feature of the present invention is the provision of such a locking and release mechanism for a cable headshell which contains one connector to be joined; in the open position, the latch extends from the face of the cable headshell, allowing entry of the latch into a cutout in the panel of a component which contains a mating connector with rotation of a lever retracting the latch towards the cable headshell and moving the latch laterally to engage the side wall of the panel cutout and thereby drawing the mating connectors into full engagement while subsequent rotation of the lever from the locked position to the open position ejects the cable headshell, thereby completely separating the mating connectors.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein:

FIG. 1 is a top plan exploded view, partly cut away and shown in section, illustrating an electrical connector assembly embodying the present invention and presenting one position of the components of the assembly;

FIG. 7 is a detail side elevation view, partly in section, enlarging a portion of FIG. 1 and illustrating one position of the components of the assembly;

FIG. 15 is a detail side elevation view, partly in section, illustrating a portion of another component of the invention.

DETAILED DESCRIPTION OF THE PREFERRED EMBODIMENT

Figure 2:
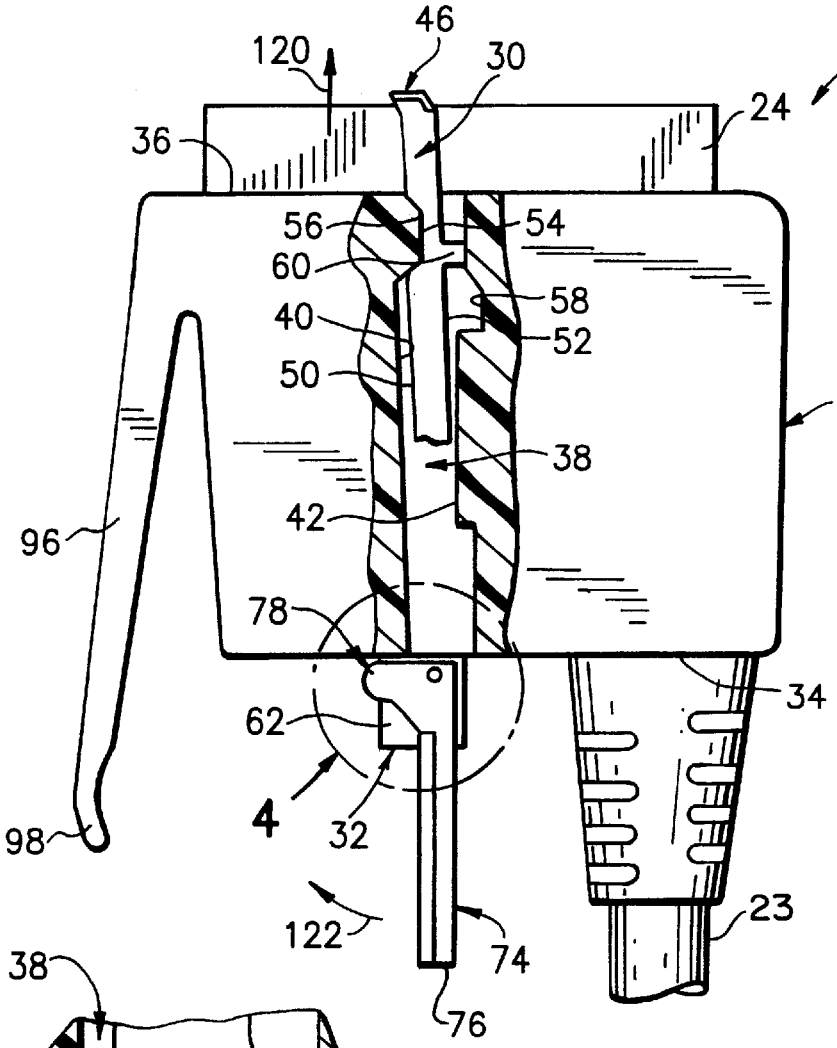
FIG. 2 is a top plan view, generally similar to FIG. 1, presenting another position of the components of the assembly.
Figure 8:
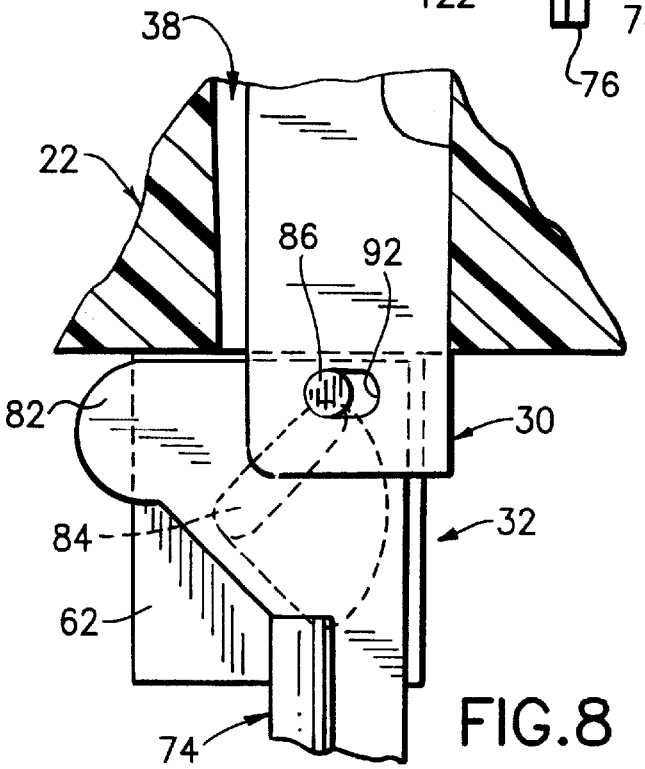
FIG. 8 is a detail side elevation view, similar to FIG. 7, illustrating another position of the components of the assembly.

Referring to FIG. 1, there is shown a detail top plan view of an electrical connector assembly, such as cable assembly 20 incorporating features of the present invention. Although the present invention will be described with reference to the embodiment shown in the drawings, it should be understood that the present invention can be embodied in many alternate forms. In addition, any suitable size, shape or type of elements or materials could be used.

A headshell 22 attached to an incoming cable 23 includes a first connector 24 for terminating a plurality of electrical leads 26 intended for mechanical and electrical connection with a mating second connector 28.

In a manner to be described in detail below, an elongated latch member 30 is movably mounted on the headshell 22 for simultaneous longitudinal and lateral movement between a first retracted position interfering with connection of the first and second mating connectors and a second advanced position enabling connection of the first and second connectors. Subsequently, when returned to the first position from the second position, the latch member 30 becomes lockingly engaged with a bulkhead 104 to which the second connector 28 mounts, or to a housing for the second connector 28, with the first and second connectors being mechanically and electrically connected. An external actuator 32 on the headshell 22 is employed for selectively moving the latch member 30 between the first and second positions.

The headshell 22 is constructed with generally parallel, spaced apart faces, a rear face 34 and a front face 36. A passage 38 extends between the rear face 34 and the front face 36 and is defined by first and second lateral opposed contoured side walls 40, 42. As best seen in FIGS. 1–6, the latch member 30 extends between a proximal end 44 pivotally connected with the external actuator 32 and a grapnel blade member 46 at a distal end for locking engagement with a housing 48 (FIG. 6) for the second connector 28. The latch member 30 is freely received within the passage 38 and is contoured along its length for cooperating engagement with the side walls 40, 42 such that when the latch member is in the earlier-mentioned first position (FIG. 1), it lies generally proximate the second side wall 42 and such that when the latch member is in the second position (FIG. 2), it lies generally proximate the first side wall 40.

The latch member 30 is further defined as having first and second opposed sides 50, 52, the first side facing the first side wall 40 of the passage 38, the second side facing the second side wall 42 of the passage. The side wall 40 has a first prominent feature or plateau 54 projecting into the passage 38 and the latch member 30 has a first recess 56 in the first side 50 which is similar in size and shape to the plateau 54. In a similar fashion, the second side wall 42 has a second recess 58 and the latch member 30 has a second prominent feature or projection 60 in the second side 52 which is slidably engageable with the second recess. The recess 56 and the plateau 54 are mutually engaged when the latch member 30 is in the second position illustrated in FIG. 2. The recess 58 and the projection 60 are mutually engaged when the latch member 30 is in the first position illustrated in FIG. 1.

Figure 10:
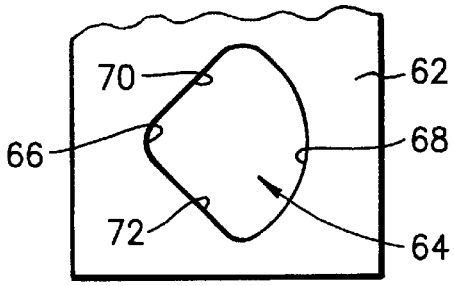
FIG. 10 is a detail side elevation view of another component of the electrical connector assembly of the invention.

With particular reference now to FIGS. 7, 8, 9, and 10, a tang element 62, preferably metal for strength and wearability, is illustrated which is integral with and projects away from the rear face 34 of the headshell 22. As best seen in FIG. 10, the tang element 62 is formed with a quadrant shaped aperture 64 extending completely through its body. The aperture 64 has an apex 66, an arcuate edge 68 defined by a radius scribed from the apex, and first and second opposed terminal edges 70, 72 of radial length as measured from the apex.

With particular attention now being drawn to FIGS. 1, 2, 7, 8, 11, 12, and 13, the external actuator 32 will now be fully described. The external actuator 32 includes a cam lever 74 extending between a normally free end 76 and a bifurcated operating end 78 having first and second spaced apart ears 80, 82. A bell crank 84 is separate from and retained between the ears 80, 82 on a pin 86 and extends laterally between them and further extends transversely through the quadrant shaped aperture 64 in the tang element 62. The bell crank 84 has a length along an interface of the bell crank with each of the spaced apart ears 80, 82 which is substantially similar to the radius of the quadrant shaped aperture 64, or length of the terminal edges 70, 72, and extends lengthwise with one end positioned proximate the apex 66 and an opposite end positioned proximate the arcuate edge 68. The bell crank is pivotally movable, as the cam lever 74 moves between one position adjacent the terminal edge 74 and another position adjacent the terminal edge 76.

As seen especially in FIGS. 7, 8, 9, 11, and 12, the operating end 78 of the cam lever 74 includes the mounting pin 86. The proximal end 44 of the latch member 30 is C-shaped (FIGS. 4 and 9) having a central bight 88, a pair of spaced apart generally parallel mounting flanges 90 extending transversely from the central bight, and axially aligned mounting holes 92 in the mounting flanges for free reception of the opposed ends of the mounting pin 86 of the cam lever 74.

Figure 14:
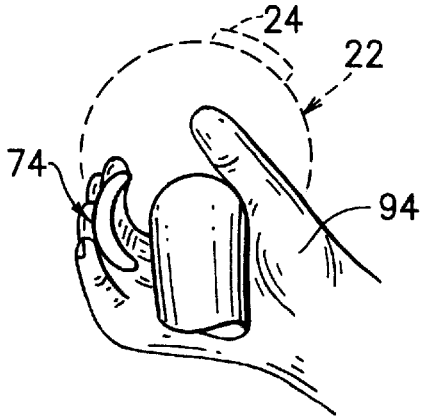
FIG. 14 is a perspective view illustrating the hand of a user manipulating the invention.
Figure 12:
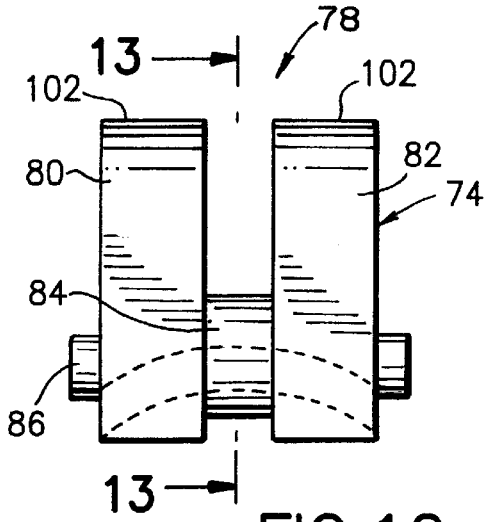
Figure 13:
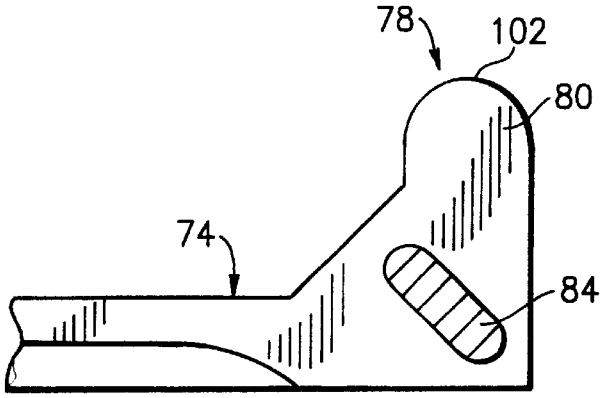

Preferably, as best seen in FIGS. 12 and 14, between the normally free end 76 and the bifurcated operating end 78, the cam lever 74 has an arcuate transverse cross section for ease of operation by the hand 94 of a user.

Turning back to FIGS. 1 and 2 and newly to FIG. 15, a release lever 96 is seen integral with the headshell 22 and arranged generally parallel with and spaced from the passage 38. The release lever 96 extends from a region proximate the front face 36 of the headshell 22 to a terminal end 98 distant from the front face 36 and has a notch 100 facing the cam lever 74. The release lever is laterally positioned to engageably receive the free end 76 of the cam lever 74 when the bell crank 84 is positioned adjacent the terminal edge 72 of the quadrant shaped aperture 64 in the tang element 62. As the cam lever 74 travels in a clockwise direction from its FIG. 2 position to its FIG. 1 position, the free end 76 of the cam lever 74 engages a ramp 101 (FIG. 15) which exists adjacent the notch 100. The cam lever 74 rides over the ramp 101 into position. The resiliency of the lever 96 returns the ramp to a location behind the cam lever 74. Thereafter, unintended movement of the cam lever is prevented. To disengage, the lever 96 is deflected outwardly (in a direction away from the cable 23), removing the ramp 101 from its location behind the free end 76 of the cam lever 74.

Now, turning to FIGS. 1, 2, 8, 9, and 11–13, each of the first and second spaced apart ears 80, 82 is seen to extend to a convex cam surface 102. The rear face 34 of the headshell 22 is engaged by the convex cam surfaces 102 when the bell crank 84 is positioned adjacent the terminal edge 72 of the aperture 64 in the tang element 62.

Turning back especially to FIGS. 3, 5, and 6, a fragmentary portion of a housing 104 is illustrated for an electrically operable component including a first bulkhead 106 and a second bulkhead 108 spaced from and generally parallel to the first bulkhead. The first bulkhead 106 has a panel cutout 110 to permit entry into the region 111 between the first and second bulkheads. A mating second connector 28 (FIG. 1 but not shown in FIG. 6) is suitably mounted on the housing 104 and the leads 26 of the first connector 24 are intended to be mechanically and electrically connected with those of the mating second connector as previously discussed.

Figure 3:
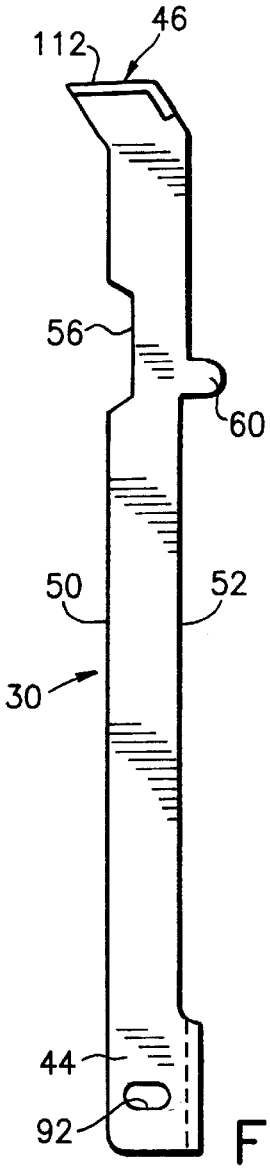
FIG. 3 is a detail side elevation view of one component of the assembly illustrated in FIGS. 1 and 2.
Figure 5:
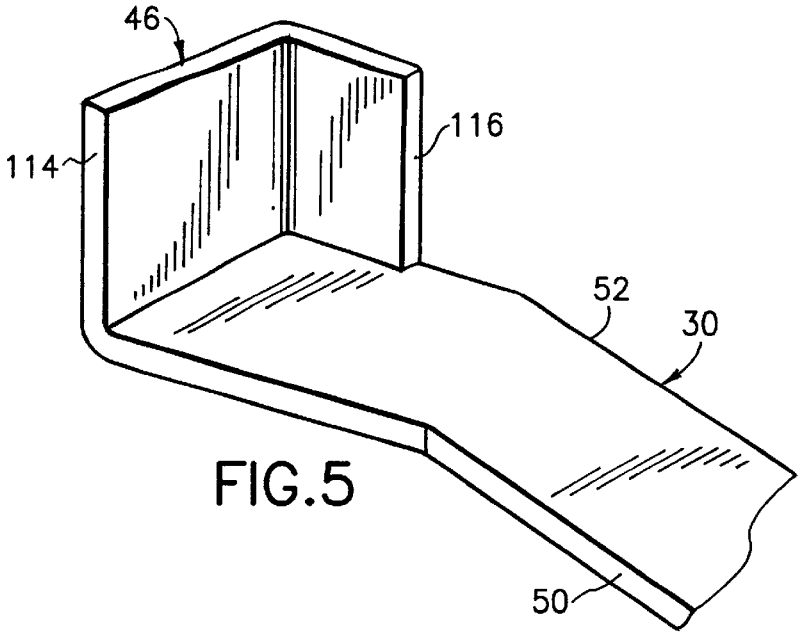
FIG. 5 is a detail perspective view of a portion of the component illustrated in FIGS. 3 and 4.
Figure 9:
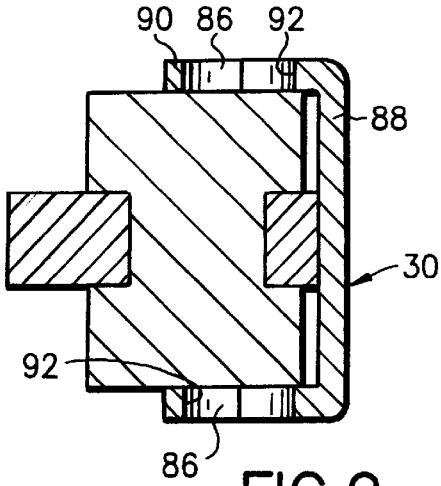
FIG. 9 is a cross section view taken generally along line 9—9 in FIG. 7.
Figure 4:
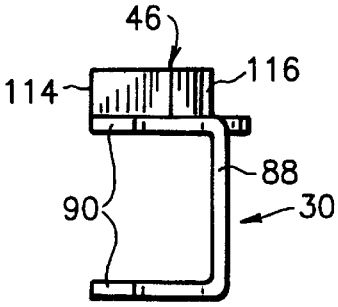
FIG. 4 is an end elevation view of the component illustrated in FIG. 3.
Figure 6:
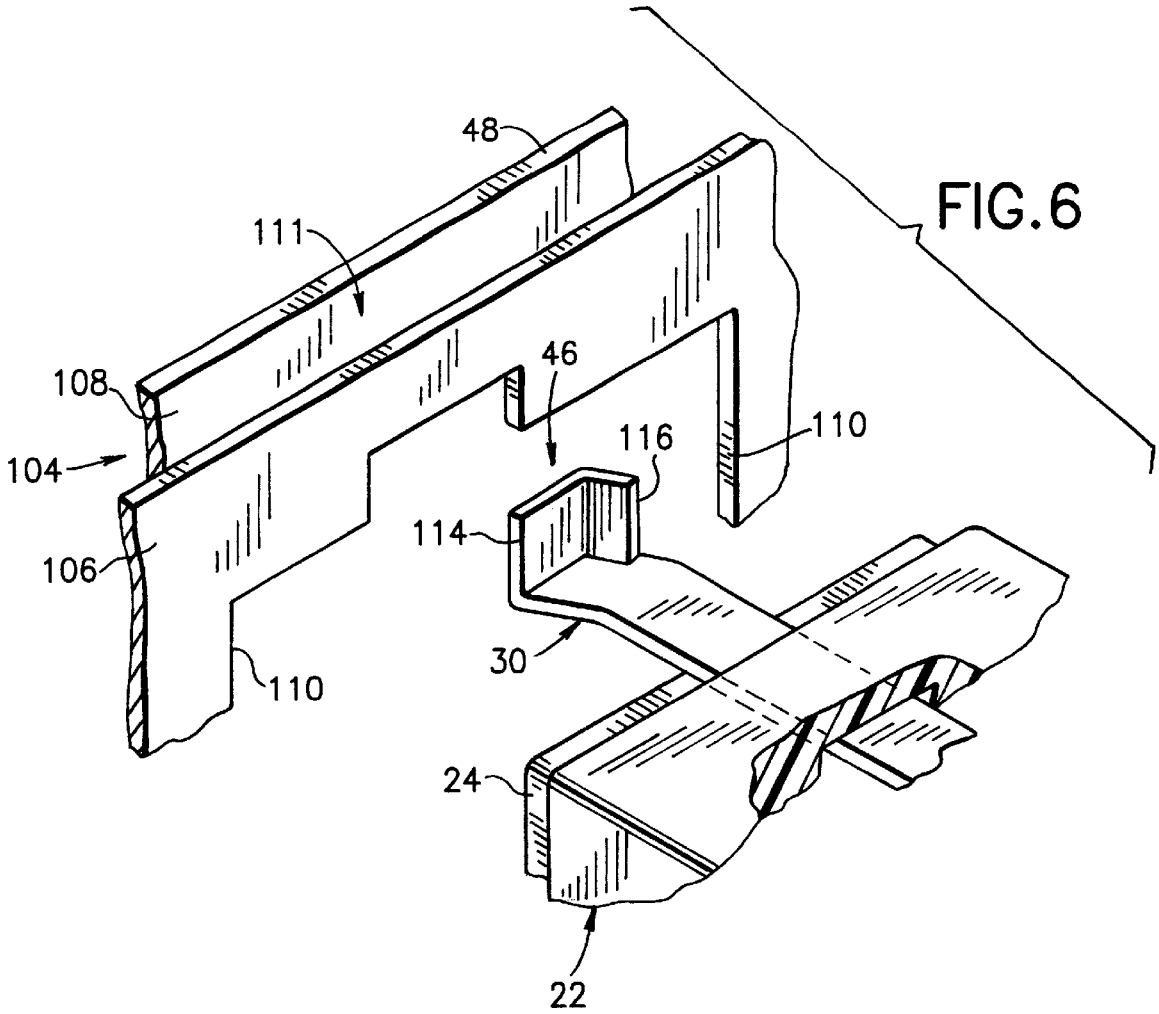
FIG. 6 is a detail exploded perspective view generally illustrating the operation of the electrical connector assembly of the present invention.
Figure 11:
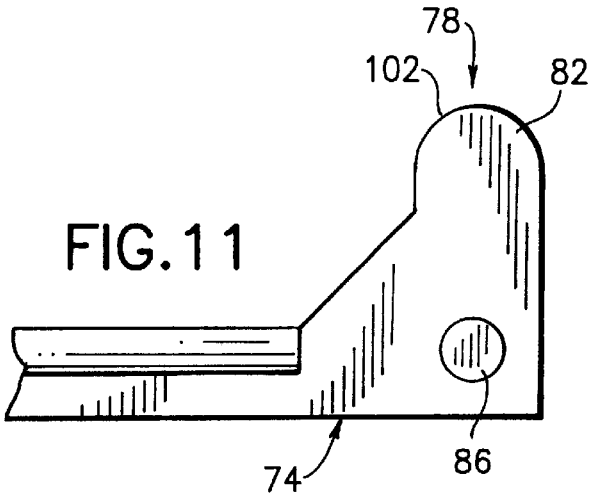
FIGS. 11, 12, and 13 are side elevation views and end elevation view, respectively, of another component of the electrical connector assembly of the invention.

With continued attention to FIGS. 3, 5, and 6, the grapnel blade member 46 is seen to lie generally in a plane transverse of the latch member 30 with a distal bearing surface 112 facing away from the proximal end 44 of the latch member 30. The grapnel blade member is further defined between first and second upstanding laterally spaced margins 114, 116, the second upstanding margin being nearer the operating end 78 of the cam lever 74. In this manner, upon entry of the grapnel blade member 46 into the panel cutout 110, with any engagement between the distal bearing surface 112 and the first bulkhead 106 adjacent the panel cutout, a camming action between the distal bearing surface 112 and the panel cutout 110 will assure the continued advance of the grapnel blade member toward and into the region between the first and second bulkhead.

Figure 16C:
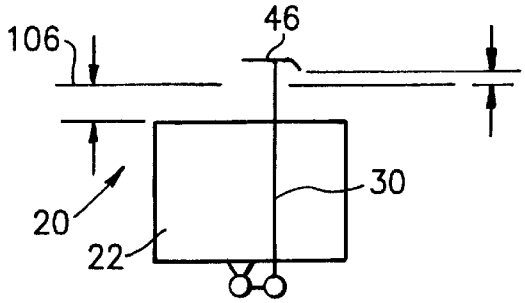
FIGS. 16A, 16B, 16C, and 16D are successive diagrammatic views illustrating successive relative positions of critical components of the invention.
Figure 16D:
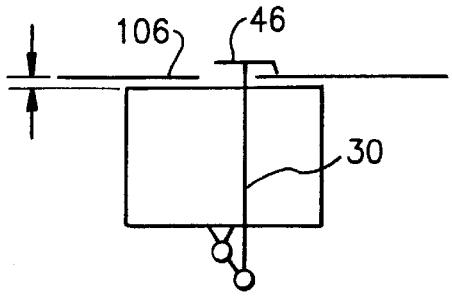
Figure 16B:
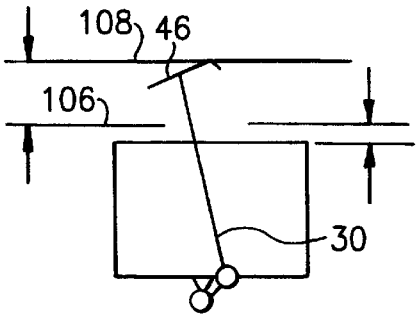
Figure 16A:
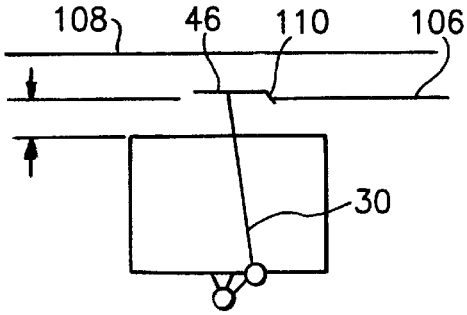

In operation, an apparatus containing the headshell 22 with the first connector 24 is positioned proximate an apparatus containing the second connector 28 so the connectors are aligned in readiness for their connection. Initially, the cam lever 74 is in the position illustrated in FIG. 1 with its free end 76 held in the notch 100 of the release lever 96. Simultaneously, the latch member 30 is in the first position lying generally proximate the second side wall 42 of the passage 38 with the projection 60 received in the recess 58 and with the plateau 54 engaging the side 50 of the latch member. Thereupon, with force applied by the user, the free end 76 of the cam lever 74 is released from engagement with the notch 100 and the cam lever is swung counterclockwise in the direction of an arrow 118 until the position indicated in FIG. 2 is reached. By reason of the connection between the mounting pins 86 and their associated mounting holes 92 in the flanges 90 at the proximal end 44 of the latch member 30, rotation of the cam lever effects movement of the latch member in the direction of an arrow 120 (FIG. 2). With this advancing movement, the distal bearing surface 112 at the canted side of the grapnel blade member 46, that is, on the side adjacent the second margin 116, moves into sliding engagement with the panel cutout 110 (FIGS. 6 and 16A), moving the latch member 30 laterally to the left until it reaches an extreme, or second, position as illustrated in FIGS. 2 and 16B. The mounting holes 92 (FIGS. 7 and 8) are elongated to accommodate this lateral motion. In the second position of the latch member 30, the projection 60 is in engagement with the second side wall 42 and the plateau 54 of the passage 38 is firmly in engagement with the recess 56 of the latch member.

Thereupon, the cam lever 74 is again operated by the user and rotated in a clockwise manner, in the direction of arrow 122 (FIG. 2). As movement of the latch member proceeds, the second margin 116 of the grapnel blade member 46 moves toward (FIG. 16C), then into engagement with (FIG. 16D), the first bulkhead 106 drawing it and its associated connector 28 into mechanical and electrical connection with the connector 26. Then, once again, the end 76 of the cam lever 74 is received into the notch 100 and secured with the release lever 96.

When it is desired to disconnect the connectors 24 and 28, the procedure just described is reversed. It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector assembly comprising:

a headshell including a first connector for terminating a plurality of electrical leads intended for mechanical and electrical connection with a mating second connector;

an elongated latch member movably mounted on the headshell for simultaneous longitudinal and lateral movement between a first retracted position and a second advanced position; and an external actuator on the headshell movably connected to the latch member for selectively moving the latch member between the first and second positions.

2. The connector assembly according to claim 1, wherein said headshell includes a passage therethrough and said elongated latch member extends through an entire length of said passageway.

3. The connector assembly according to claim 1, wherein said latch member slides in said longitudinal and lateral directions.

4. The connector assembly according to claim 1, wherein said latch member is attached to said external actuator via a pin and hole.

5. An electrical connector assembly comprising:

a headshell including a first connector for terminating a plurality of electrical leads intended for mechanical and electrical connection with a mating second connector;

an elongated latch member movably mounted on the headshell for non-rotational movement between a first retracted position and a second advanced position; and an external actuator on the headshell for selectively moving the latch member between the first and second positions.

* * * * *